US006453585B1

(12) United States Patent
Takahashi et al.

(10) Patent No.: US 6,453,585 B1
(45) Date of Patent: Sep. 24, 2002

(54) HYDRAULIC DRIVE DEVICE OF WORKING MACHINE

(75) Inventors: Kinya Takahashi; Yoshizumi Nishimura, both of Tsuchiura; Yusaku Nozawa, Higashiibaraki-gun; Mitsuhisa Tougasaki, Niihari-gun, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/980,543

(22) PCT Filed: Apr. 9, 2001

(86) PCT No.: PCT/JP01/03043

§ 371 (c)(1),
(2), (4) Date: Apr. 12, 2001

(87) PCT Pub. No.: WO01/77532

PCT Pub. Date: Oct. 18, 2001

(30) Foreign Application Priority Data

Apr. 10, 2000 (JP) ..... 2000-108408

(51) Int. Cl.[7] ..... F15B 11/00; E02F 9/22

(52) U.S. Cl. ..... 37/348; 417/213; 417/216; 60/443; 60/445

(58) Field of Search ..... 37/348, 234; 417/212, 417/213, 216, 218, 222.2, 222.1, 34; 60/444, 443, 449, 445, 452

(56) References Cited

U.S. PATENT DOCUMENTS 4,637,781 A 1/1987 Akiyama et al. ..... 417/216

FOREIGN PATENT DOCUMENTS

| | | |
|---|---|---|
| JP | 4-312630 | 11/1992 |
| JP | 6-117411 | 4/1994 |
| JP | 9-235759 | 9/1997 |
| JP | 11-230112 | 8/1999 |
| JP | 11-247236 | 9/1999 |
| WO | 89/12756 | 12/1989 |
| WO | 90/7031 | 6/1990 |

*Primary Examiner*—Christopher J. Novosad
(74) *Attorney, Agent, or Firm*—Crowell & Moring LLP

(57) ABSTRACT

To permit forcedly stopping combining flows of pressure fluid from two hydraulic pumps when a load pressure on a combined-flow-driven actuator in which the flows of pressure fluid are combined together exceeds a predetermined pressure and hence to permit driving the combined-flow-driven actuator with the pressure fluid from only one of the hydraulic pumps, a hydraulic drive system is provided with a flow-combining valve 2 connected to a directional control valve 1 in a first group of directional control valves via a center bypass passage 3, a flow-combining circuit 5 communicating the flow-combining valve 2 and a supply port of a flow-combining directional control valve 4 with each other, and a combined-flow-driven actuator 20 controlled by the flow-combining directional control valve 4, and performs overall power control such that a total value of input torques to the two hydraulic pumps 15,18 does not exceed an output torque from an engine 30. The hydraulic drive system is provided with a canceling valve 10 to cancel the combination of flows by the flow-combining valve 2 when a load pressure on the combined-flow-driven actuator 20 becomes higher than a predetermined pressure.

5 Claims, 5 Drawing Sheets

HYDRAULIC DRIVE DEVICE OF WORKING MACHINE

TECHNICAL FIELD

This invention relates to a hydraulic drive system for a work machine such as a hydraulic excavator, and especially to a hydraulic drive system for a work machine, said hydraulic drive system being provided with a flow-combining valve for combining flows of pressure fluid from two hydraulic pumps and being adapted to perform overall power control such that a total value of all torques including input torques to the two hydraulic pumps does not exceed an output torque from an engine.

BACKGROUND ART

FIG. 5 is a hydraulic circuit diagram showing the construction of a conventional hydraulic drive system for a work machine.

The conventional technique illustrated in FIG. 5 is applied, for example, to a hydraulic excavator, and is provided with an engine 30 and a first and second hydraulic pumps 15,18 both of which are of the variable displacement type and are driven by the engine 30. To the first hydraulic pump 15, a first group of directional control valves consisting of plural center-bypassed directional control valves is connected. To the second hydraulic pump 18, a second group of directional control valves consisting of plural center-bypassed directional control valves is connected likewise. In the second group of directional control valves, a flow-combining directional control valve 4 for changing over and controlling a combined-flow-driven actuator 20 is included. To a directional control valve 1 positioned most downstream of the first group of directional control valves connected to the above-mentioned first hydraulic pump 15, a flow-combining valve 2 is connected via a center bypass passage 3 such that pressure fluid from the first hydraulic pump 15 can be supplied, in combination with pressure fluid from the second hydraulic pump 18, to the aforementioned flow-combining directional control valve 4. The flow-combining valve 2 and a supply port of the flow-combining directional control valve 4 are connected to each other by a flow-combining circuit 5.

The aforementioned flow-combining valve 2 is arranged such that, depending on the magnitude of a pilot pressure in a pilot line 7 through which the pilot pressure is guided to change over the flow-combining directional control valve 4, the flow-combining valve 2 is changed over from an open position at which the center bypass passage 3 and a reservoir 17 are communicated with each other to a closed position at which the center bypass passage 3 and the reservoir 17 are cut off from each other or conversely, from the closed position to the open position.

An attachment which is driven by the aforementioned combined-flow-driven actuator 20 comprises a predetermined attachment mounted on a free end of an arm of the hydraulic excavator, for example, a breaker. On the free end of the arm, a bucket is generally mounted. By removing the bucket, this breaker is mounted instead.

FIG. 5 also illustrates a parallel line 21 via which the individual directional control valves included in the second group of directional control valves are connected parallel to the second hydraulic pump 18, a reservoir passage 19 communicating the center bypass passage of the second group of directional control valves and the reservoir 17 with each other, a check valve 22 for preventing pressure oil in the flow-combining line 5 from flowing toward the parallel line 21, and a check valve 6 for preventing the pressure fluid in the flow-combining line 5 from flowing toward the center bypass passage 3.

According to the conventional technique constructed as described above, when any one of the individual directional control valves is changed over except for a change-over operation that the flow-combining directional control valve 4 is changed over to the right position of FIG. 5, no pilot pressure is developed in the pilot line 7, and the flow-combining valve 2 is thus held in the open position by the force of a spring. Namely, the center bypass passage 3 is maintained in communication with the reservoir 17. In this state, change-over of one or more of the directional control valves included in the first group of directional control valves makes it possible to supply the pressure fluid from the first hydraulic pump 15 to the corresponding directional control valve(s) only, and change-over of one or more of the directional control valves included in the second group of directional control valves makes it possible to supply the pressure fluid from the second hydraulic pump 18 to the corresponding directional control valve(s) only.

When the pilot pressure is guided into the pilot line 7 upon driving the combined-flow-driven actuator 20, the flow-combining directional control valve 4 is changed over to the right position of FIG. 5 and at the same time, the flow-combining valve 2 is changed over to the closed position against the force of the spring. As a consequence, the center bypass passage 3 and the reservoir 17 are cut off from each other.

Accordingly, the pressure fluid from the first hydraulic pump 15 is supplied, in combination with the pressure fluid from the second hydraulic pump 18, to the supply port of the flow-combining directional control valve 4 via the center bypass passage 3, the flow-combining circuit 5 and the check valve 6. The combined pressure fluid of the pressure fluid from the first hydraulic pump 15 and the pressure fluid from the second hydraulic pump 18 is supplied from the flow-combining directional control valve 4 to the combined-flow-driven actuator 20. The combined-flow-driven actuator 20 is, therefore, actuated to drive the unillustrated breaker so that breaking work or the like of rocks is performed.

To perform combined operation of the breaker and an unillustrated arm and/or boom or combined operation of the breaker and running and/or revolving, the corresponding one or more of the directional control valves included in the first group of directional control valves, for example, may also be changed over at the same time. In this case, the pressure fluid from the first hydraulic pump 15 is supplied to the corresponding one or more directional control valves. At this time, the center bypass passage(s) of the corresponding one or more directional control valves, in many instances, is(are) not completely closed in actual work, so that there is also a tendency that a portion of the pressure fluid from the first hydraulic pump 15 is also supplied to the flow-combining line 5. In other words, the combined-flow-driven actuator 20 tends to be brought into such a situation that it is driven by the portion of the pressure fluid from the first hydraulic pump 15 and the pressure fluid from the second hydraulic pump 18.

While these operations are carried out, overall power control is performed such that a total value of input torques to the first hydraulic pump 15 and the second hydraulic pump 18 does not exceed an output torque from the engine 30 to avoid stalling.

In the above-described conventional technique, a load pressure on the combined-flow-driven actuator 20 may become high for a certain reason in the course of work that the unillustrated breaker is driven by a combined flow of the pressure fluid from the first hydraulic pump 15 and that from the second hydraulic pump 18. Corresponding to the load pressure, a delivery pressure on the side of the second hydraulic pump 18 then becomes high, and a delivery pressure on the side of the first hydraulic pump 15 also becomes high. As a result, a total value of an input torque to the first hydraulic pump 15 and an input torque to the second hydraulic pump 18 becomes large, and an output torque from the engine 30 also increases.

When the load pressure on the combined-flow-driven actuator 20 becomes high as mentioned above, there is a situation that force is required more than speed. Combining the pressure fluid from the first hydraulic pump 15 with the pressure fluid from the second hydraulic pump 18 in such a situation leads to an increase in the output torque from the engine 30 as mentioned above. As a consequence, the fuel consumption increases, developing a problem in economy.

For example, in the course of combined operation of another actuator (not shown) driven by the pressure fluid from the first hydraulicpump 15 and the combined-flow-driven actuator 20 driven by a combined flow of a portion of the pressure fluid from the first hydraulic pump 15 and the pressure fluid from the second hydraulic pump 18, the load pressure on the combined-flow-driven actuator 20 may become high, resulting in a situation that force is required more than speed as mentioned above. In such a situation, it is not preferred to continue combining the pressure fluid from the first hydraulic pump 15 with that from the second hydraulic pump 18 when the operator wants to increase the speed of the other actuator driven by the hydraulic pressure from the first hydraulic pump 15.

Sufficient force can be assured by the delivery pressure of the second hydraulic pump 18. When such a situation arises, it is, therefore, often preferred from the standpoint of overall work efficiency to stop the combination of the flows despite a decrease in the speed of the combined-flow-driven actuator 20 and hence, to make it possible to supply the pressure fluid from the first hydraulic pump 15 in its entirety to the other actuator such that its speed can be increased.

With the foregoing circumstances of the conventional technique in view, the present invention has as an object the provision of a hydraulic drive system for a work machine, which, when a load pressure on a combined-flow-driven actuator in which flows of pressure fluid from two hydraulic pumps are combined becomes higher than a predetermined pressure, forcedly stops the combination of flows of pressure fluid to permit the driving of the combined-flow-driven actuator with the pressure fluid from one of the hydraulic pumps.

DISCLOSURE OF THE INVENTION

To achieve the above-described object, the present invention provides a hydraulic drive system for a work machine, the hydraulic drive system being provided with an engine, a first and second variable displacement hydraulic pumps drivable by the engine, a first group of center-bypassed directional control valves connected to the first hydraulic pump, a second group of center-bypassed directional control valves connected to the second hydraulic pump and including a flow-combining directional control valve, a flow-combining valve connected to a most downstream directional control valve of the first group of directional control valves via a center bypass passage to supply pressure fluid from the first hydraulic pump, in combination with pressure fluid from the second hydraulic pump, to the flow-combining directional control valve in the second group of directional control valves, a flow-combining circuit communicating the flow-combining valve and a supply port of the flow-combining directional control valve with each other, a combined-flow-driven actuator controlled by the flow-combining directional control valve, and a variable displacement controller for performing overall power control such that a total value of an input torque to the first hydraulic pump and an input torque to the second hydraulic pump does not exceed an output torque of the engine, comprising a canceling valve for canceling the flow combination by the flow-combining valve when a load pressure on the combined-flow-driven actuator becomes higher than a predetermined pressure.

According to the present invention constructed as described above, the flow-combining directional control valve is changed over to actuate the flow-combining valve such that the pressure fluid from the first hydraulic pump is supplied to the supply port of the flow-combining directional control valve via the flow-combining valve and the flow-combining circuit to drive the combined-flow-driven actuator with the combined pressure fluid of the pressure fluid from the first hydraulic pump and that from the second hydraulic pump. An increase in the load pressure on the combined-flow-driven actuator beyond the predetermined pressure in the course of this driving of the combined-flow-driven actuator actuates the canceling valve to cancel the combination of the flows so that the supply of the pressure fluid from the first hydraulic pump to the flow-combining directional control valve via the flow-combining circuit is forcedly stopped. As a result, only the pressure fluid from the second hydraulic pump is supplied to the combined-flow-driven actuator via the flow-combining directional control valve. In other words, the combined-flow-driven actuator is brought into a situation where it is driven only with the pressure fluid from the second hydraulic pump.

Although the input torque to the second hydraulic pump becomes greater as the load pressure on the combined-flow-driven actuator becomes higher, the input torque to the first hydraulic pump which is not affected by the load pressure on the combined-flow-driven actuator can be rendered smaller accordingly. It is, therefore, possible to keep small the total value of the input torques to the first and second hydraulic pumps. As a consequence, it is possible to reduce an increase in the output torque from the engine.

Next assume that combined operation of another actuator, which is driven and controlled by a directional control valve included in the first group of directional control valves connected to the first hydraulic pump, and the combined-flow-driven actuator is being performed. When the load pressure on the combined-flow-driven actuator becomes higher than the predetermined pressure in the situation that the combined-flow-driven actuator is driven by the combined flow of the portion of the pressure fluid from the first hydraulic pump and the pressure fluid from the second hydraulic pump, the combination of the flows is canceled as mentioned above. The pressure fluid from the first hydraulic pump is, therefore, not supplied to the combined-flow-driven actuator, thereby making it possible to supply the pressure fluid from the first hydraulic pump to the above-mentioned other actuator only. Further, the delivery pressure of the first hydraulic pump is no longer affected by the load pressure on the combined-flow-driven actuator, said load pressure having increased beyond the predetermined pressure, and therefore, can be kept smaller compared with the delivery pressure of the second hydraulic pump. This makes it possible to assure a relatively large flow rate in accordance with the so-called P-Q characteristics (pump-delivery pressure characteristics), thereby making it possible to assure sufficient force by the combined-flow-driven actuator and also to increase the speed of the other actuator during such combined operation.

In the above-mentioned construction, the canceling valve may be arranged in a circuit communicating the center bypass passage, which is located between the most downstream directional control valve of the first group of directional control valves and the flow-combining valve, and a reservoir with each other, and may be set to be actuatable responsive to a pressure in the flow-combining circuit.

Further, in the above-mentioned construction, the canceling valve may be incorporated in the flow-combining valve.

In the hydraulic drive system constructed as described above, the flow-combining valve and the canceling valve are formed as an integral unit, thereby achieving a reduction in size.

Furthermore, in the above-mentioned construction, the work machine may be a hydraulic excavator, and an attachment drivable by said combined-flow-driven actuator may be a predetermined accessory mounted on a free end of an arm.

BEST MODES FOR CARRYING OUT THE INVENTION

The embodiments of the hydraulic drive system according to the present invention for the work machine will hereinafter be described based on the drawings.

Figure 1:
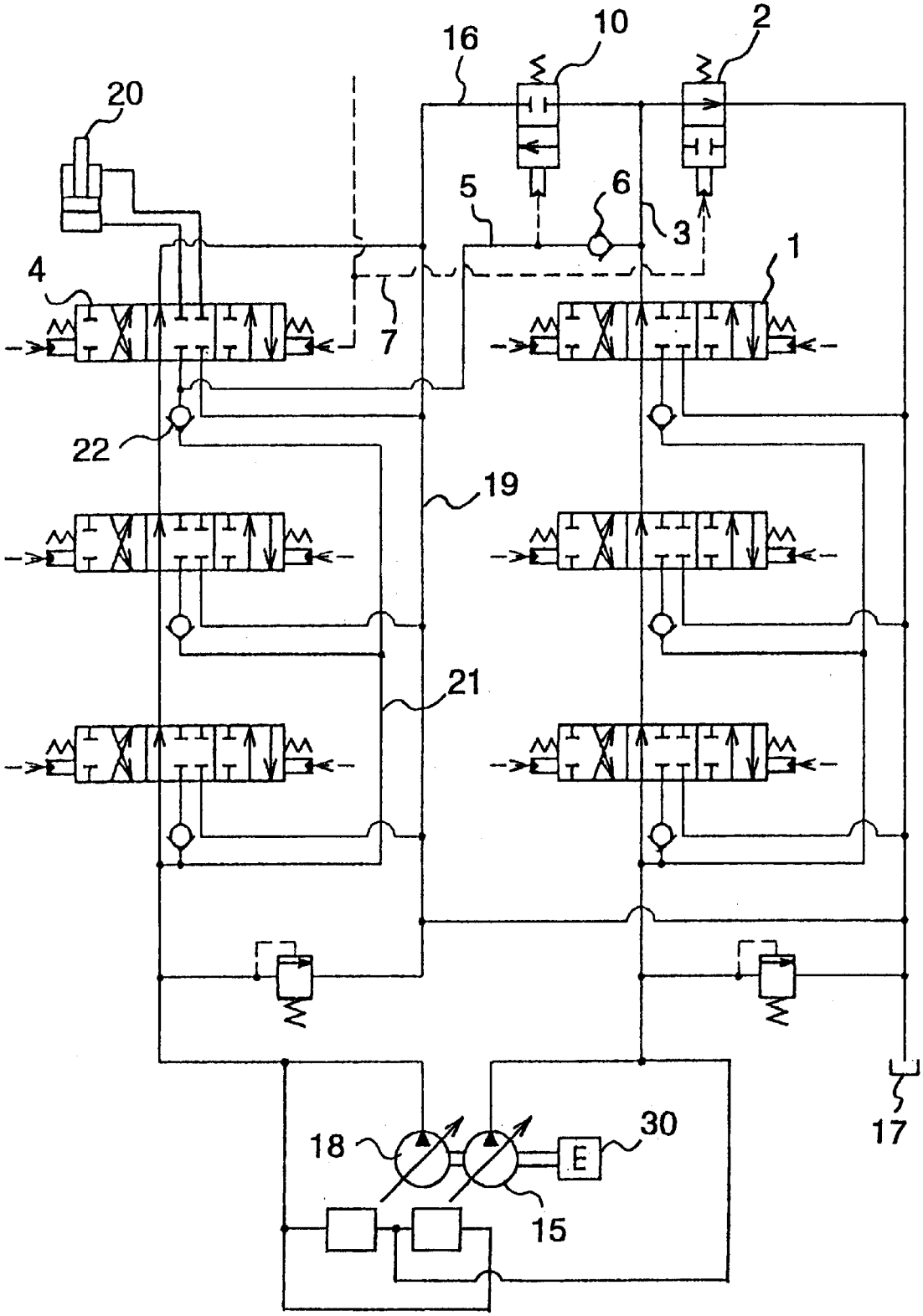
FIG. 1 is a hydraulic circuit diagram showing the construction of a first embodiment of the hydraulic drive system according to the present invention for the work machine.

FIG. 1 is the hydraulic circuit showing the construction of the first embodiment of the hydraulic drive system according to the present invention for the work machine. FIG. 1 was drawn corresponding to the above-mentioned FIG. 5. In FIG. 1, those equivalent to the above-mentioned hydraulic equipment are indicated by like reference numerals.

Described specifically, the first embodiment illustrated in FIG. 1 is also applied, for example, to a hydraulic excavator, and is provided with an engine 30 and a first and second hydraulic pumps 15,18 both of which are of the variable displacement type. To the first hydraulic pump 15, a first group of center-bypassed directional control valves is connected. Connected to the second hydraulic pump 18 is a second group of center-bypassed directional control valves which include a flow-combining directional control valve 4 for changing over and controlling a combined-flow-driven actuator 20. To a directional control valve 1 positioned most downstream of the first group of directional control valves, a flow-combining valve 2 is connected via a center bypass passage 3. The flow-combining valve 2 and a supply port of the flow-combining directional control valve 4 are connected to each other by a flow-combining circuit 5. An attachment which is driven by the combined-flow-driven actuator 20 comprises a predetermined attachment mounted on a free end of an arm of the hydraulic excavator, for example, a breaker. There are also illustrated a parallel line 21, a reservoir passage 19, and check valves 22,6. The above-described construction is similar to the above-mentioned first embodiment.

This first embodiment is provided with a canceling valve 10, which cancels the combination of flows by the flow-combining valve 2 especially when the load pressure on the combined-flow-driven actuator 20 becomes higher than the predetermined pressure. This canceling valve 10 is arranged in a circuit communicating a portion of the center bypass passage 3, said portion being positioned between the most downstream directional control valve 1 of the first group of directional control valves, and a reservoir 17 to each other, that is, a reservoir passage 16, and is set such that it is actuatable responsive to a pressure in the flow-combining circuit 5.

Figure 5:
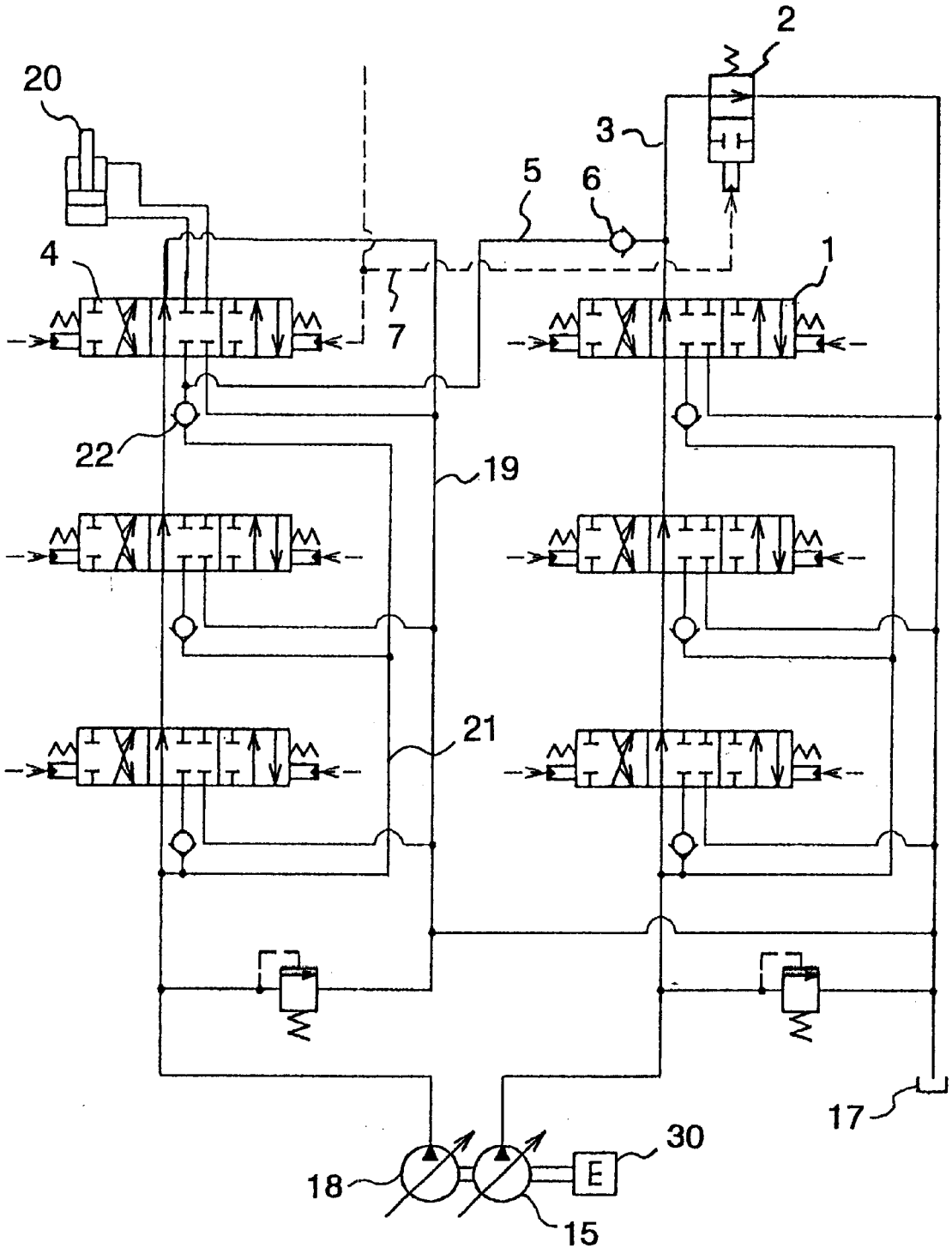
FIG. 5 is a hydraulic circuit diagram showing the construction of a conventional hydraulic drive system for a work machine.

Basic operations in the first embodiment are substantially the same as those of the aforementioned conventional hydraulic drive system shown in FIG. 5. These basic operations will hereinafter be described although there will be a repetition of the above description. When any one of the individual directional control valves is changed over except for the change-over operation that the flow-combining directional control valve 4 is changed over to the right position of FIG. 1, no pilot pressure is developed in the pilot line 7. Therefore, the flow-combining valve 2 is thus held in the open position by the force of a spring, and the center bypass passage 3 is maintained in communication with the reservoir 17. When the flow-combining directional control valve 4 is held neutral or even when the flow-combining directional control valve 4 is changed over to the left position of FIG. 1, the canceling valve 10 is held in the closed position shown in FIG. 1 by the force of the spring and cuts off the reservoir passage 16 when the load pressure on the combined-flow-driven actuator 20 is lower than the predetermined pressure.

In this state, change-over of one or more of the directional control valves included in the first group of directional control valves makes it possible to supply the pressure fluid from the first hydraulic pump 15 to the corresponding directional control valve(s) only, and change-over of one or more of the directional control valves included in the second group of directional control valves makes it possible to supply the pressure fluid from the second hydraulic pump 18 to the corresponding directional control valve(s) only.

When the pilot pressure is guided into the pilot line 7 upon driving the combined-flow-driven actuator 20, the flow-combining directional control valve 4 is changed over to the right position of FIG. 1 and at the same time, the flow-combining valve 2 is changed over to the closed position against the force of the spring. As a consequence, the center bypass passage 3 and the reservoir 17 are cut off from each other. In this case, when the load pressure on the combined-flow-driven actuator 20 is lower than the predetermined pressure, the canceling valve 10 is held in the closed position shown in FIG. 1 by the force of the spring, and cuts off the reservoir passage 23, as mentioned above.

In this state, the pressure fluid from the first hydraulic pump 15 is supplied, in combination with the pressure fluid from the second hydraulic pump 18, to the supply port of the flow-combining directional control valve 4 via the center bypass passage 3, the flow-combining circuit 5 and the check valve 6. The combined pressure fluid of the pressure fluid from the first hydraulic pump 15 and the pressure fluid from the second hydraulic pump 18 is supplied from the flow-combining directional control valve 4 to the combined-flow-driven actuator 20. The combined-flow-driven actuator 20 is, therefore, actuated to drive an unillustrated breaker so that breaking work or the like of rocks is performed.

To perform combined operation of the breaker and an unillustrated arm and/or boom or combined operation of the breaker and running and/or revolving, the corresponding one or more of the directional control valves included in the first group of directional control valves, for example, may also be changed over at the same time. In this case, the pressure fluid from the first hydraulic pump 15 is supplied to the corresponding one or more directional control valves. At this time,the center bypass passages of the corresponding one or more directional control valves, in many instances, are not completely closed in actual work as mentioned above, so that there is also a tendency that a portion of the pressure fluid from the first hydraulic pump 15 also flows into the flow-combining circuit 5. In other words, the combined-flow-driven actuator 20 tends to be brought into such a situation that it is driven by the portion of the pressure fluid from the first hydraulic pump 15 and the pressure fluid from the second hydraulic pump 18. While these operations are carried out, overall power control is performed such that a total value of input torques to the first hydraulic pump 15 and the second hydraulic pump 18 does not exceed an output torque from the engine 30 to avoid stalling.

In this first embodiment, the load pressure on the combined-flow-driven actuator 20 is continuously applied to a control portion of the canceling valve 10 via the flow-combining circuit 5 especially while the combined-flow-driven actuator 20 is actuated with the combined flow of the pressure fluids from the two hydraulic pumps 15,18. When the load pressure becomes higher than the predetermined pressure, however, the canceling valve 10 is changed over to the open position against the force of the spring.

As a result, the center bypass passage 3 on the side of the first group of directional control valves is brought into communication with the reservoir passage 16 via the canceling valve 10, and the combination of flows by the flow-combining valve 2 is canceled. When this state is established, change-over of one or more directional control valves included in the first group of directional control valves makes it possible to supply the pressure fluid from the first hydraulic pump 15 to the corresponding directional control valve(s) only so that only the pressure fluid from the second hydraulic pump 18 is supplied to the combined-flow-driven actuator 20 via the flow-combining directional control valve 4.

When the load pressure on the combined-flow-driven actuator 20 becomes lower than the predetermined pressure in the above-described state or when the flow-combining directional control valve 4 is caused to return to the neutral position in the above-described state, the canceling valve 10 returns by the force of the spring to the initial state, that is, to the closed position where the canceling valve 10 cuts off the reservoir passage 16. When the flow-combining directional control valve 4 is not caused to return to the neutral position and the load pressure on the combined-flow-driven actuator 20 becomes lower than the predetermined pressure, the combination of flows is performed again.

When the flow-combining directional control valve 4 is caused to return to the neutral position or is changed over to the left position of FIG. 1, on the other hand. no pressure is developed in the pilot line 7, and the flow-combining valve 2 is changed over by the force of the spring to the upper position of FIG. 1, that is, to the open position. As a result, the center bypass passage 3 is brought into communication with the reservoir 17 so that the combination of the pressure fluid from the first hydraulic pump 15 with the pressure fluid from the second hydraulic pump 18 is no longer performed.

When this state is established, change-over of one or more of the directional control valves included in the first group of directional control valves makes it possible to supply the pressure fluid from the first hydraulic pump 15 to the corresponding directional control valve(s) only, and change-over of one or more of the directional control valves included in the second group of directional control valves makes it possible to supply the pressure fluid from the second hydraulic pump 18 to the corresponding directional control valve(s) only, as mentioned above.

In the first embodiment constructed as described above, when the load pressure on the combined-flow-driven actuator 20 becomes higher than the predetermined pressure while the flows of pressure fluid are being combined, the canceling valve 10 is actuated to cancel the combination of flows as mentioned above. It is, therefore, possible to reduce the input torque to the first hydraulic pump 15 which is not affected by the load pressure on the combined-flow-driven actuator 20, although the input torque to the second hydraulic pump 18 becomes greater by an increase in the load pressure on the combined-flow-driven actuator 20. Accordingly, it is possible to keep small the total value of the input torques to these first hydraulic pump 15 and second hydraulic pump 18. As a consequence, an increase in the output torque from the engine 30 can be reduced so that the fuel consumption can be lowered. This is economical. No trouble or inconvenience arises on the work by the breaker driven by the combined-flow-driven actuator 20, because the force required by the combined-flow-driven actuator 20 can be assured owing to an increase in the delivery pressure of the second hydraulic pump 18.

Also assume that combined operation of another actuator, which is not shown and is driven by the pressure fluid from the first hydraulic pump 15, and the combined-flow-driven actuator 20 is being performed. When the load pressure on the combined-flow-driven actuator 20 becomes higher than the predetermined pressure in the situation that the combined-flow-driven actuator 20 is driven by the combined flow of a portion of the pressure fluid from the first hydraulic pump 15 and the pressure fluid from the second hydraulic pump 18, the combination of the flows is canceled by the actuation of the canceling valve 10 as mentioned above. The pressure fluid from the first hydraulic pump 15 is, therefore, not supplied to the combined-flow-driven actuator 20, thereby making it possible to supply the pressure fluid from the first hydraulic pump 15 to the above-mentioned other actuator only. Further, the delivery pressure of the first hydraulic pump 15 is no longer affected by the load pressure on the combined-flow-driven actuator 20, and therefore, can be kept smaller compared with the delivery pressure of the second hydraulic pump 18. This makes it possible to assure a relatively large flow rate in accordance with the so-called P-Q characteristics (pump-delivery pressure characteristics), thereby making it possible to assure sufficient force by the combined-flow-driven actuator 20 and also to increase the speed of the other actuator during such combined operation. As a consequence, the overall work efficiency can be improved.

Figure 2:
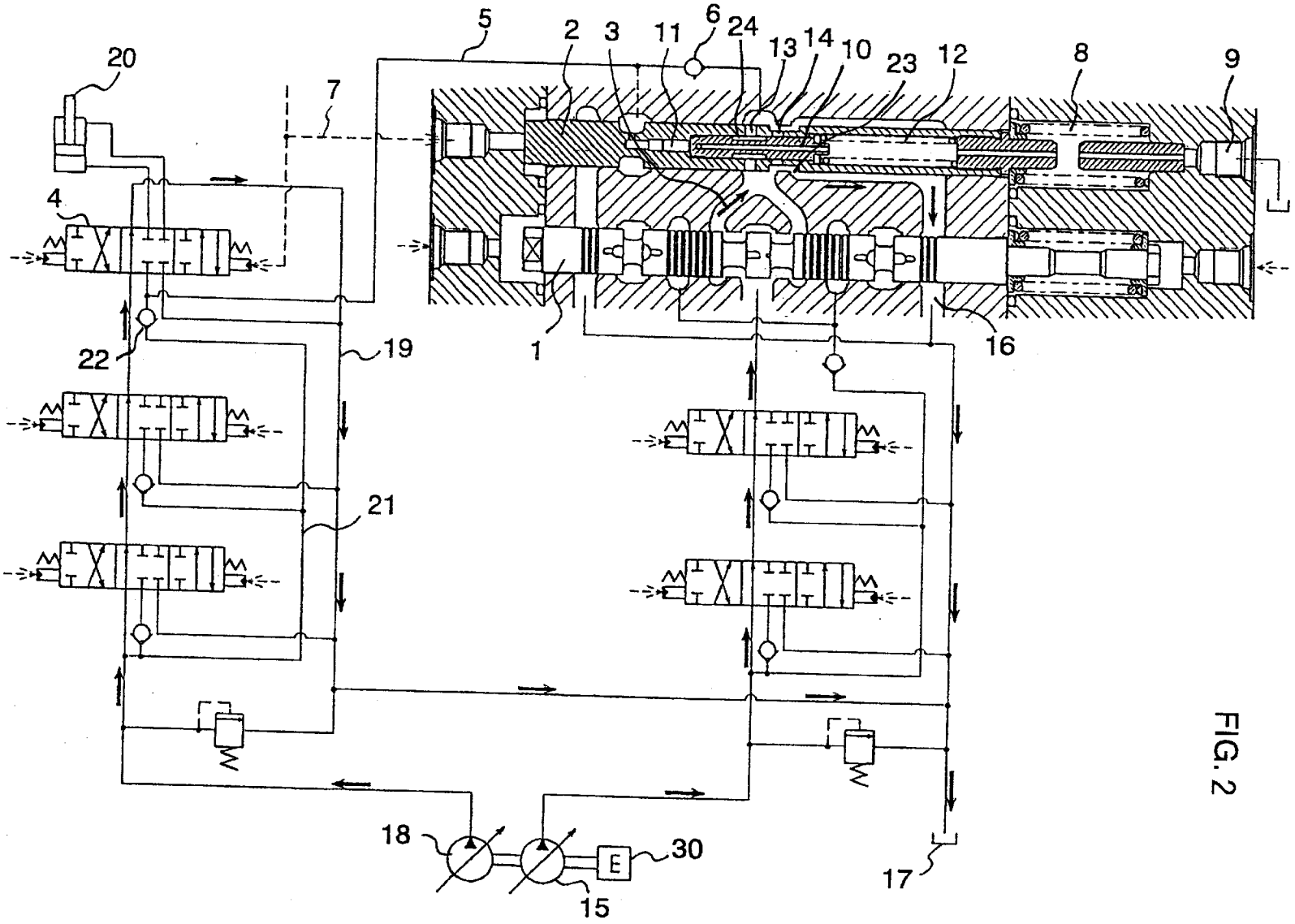
FIG. 2 is a hydraulic circuit diagram illustrating a second embodiment of the present invention at a neutral time.
Figure 3:
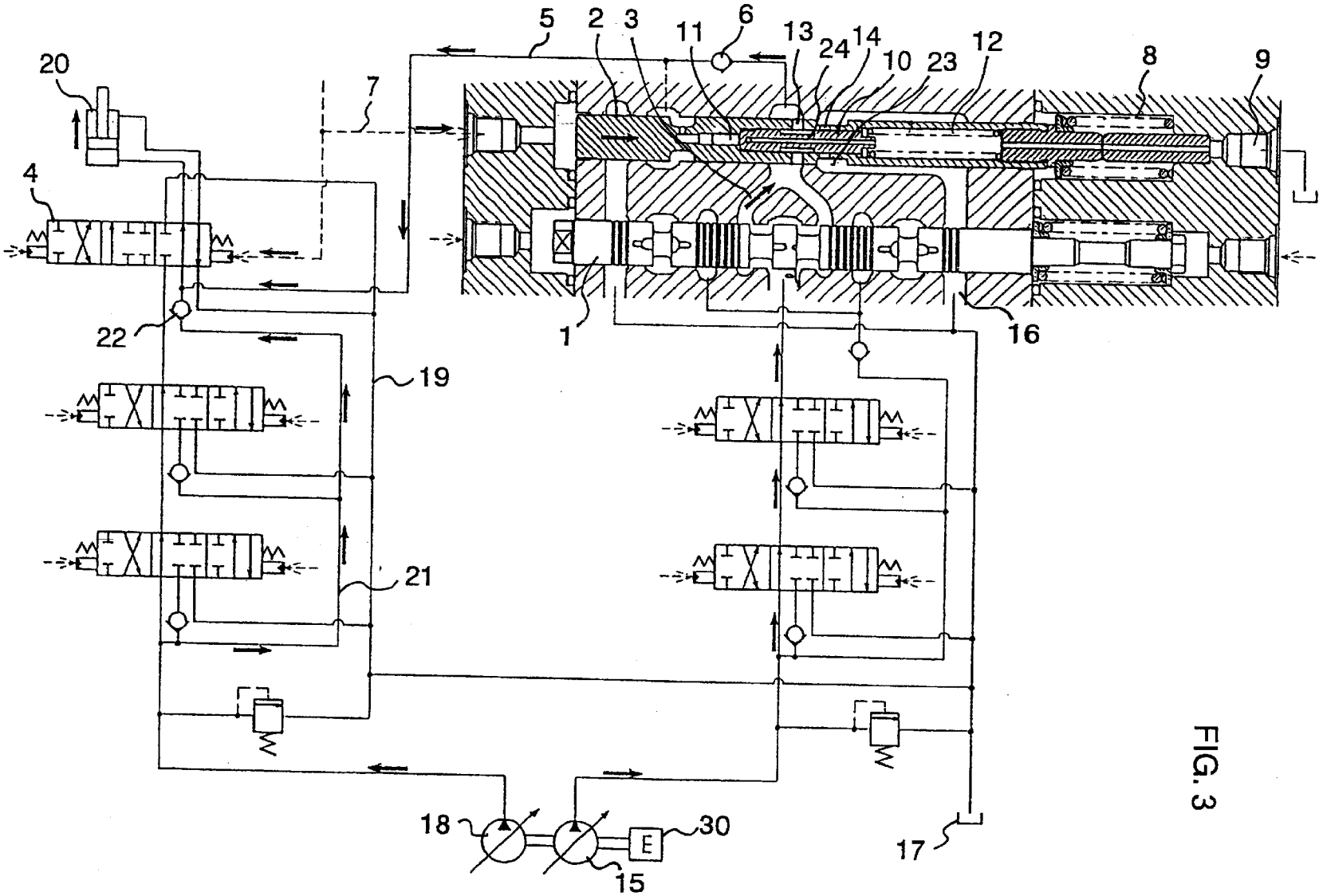
FIG. 3 is a hydraulic circuit diagram illustrating the second embodiment of the present invention at a flow-combining time.
Figure 4:
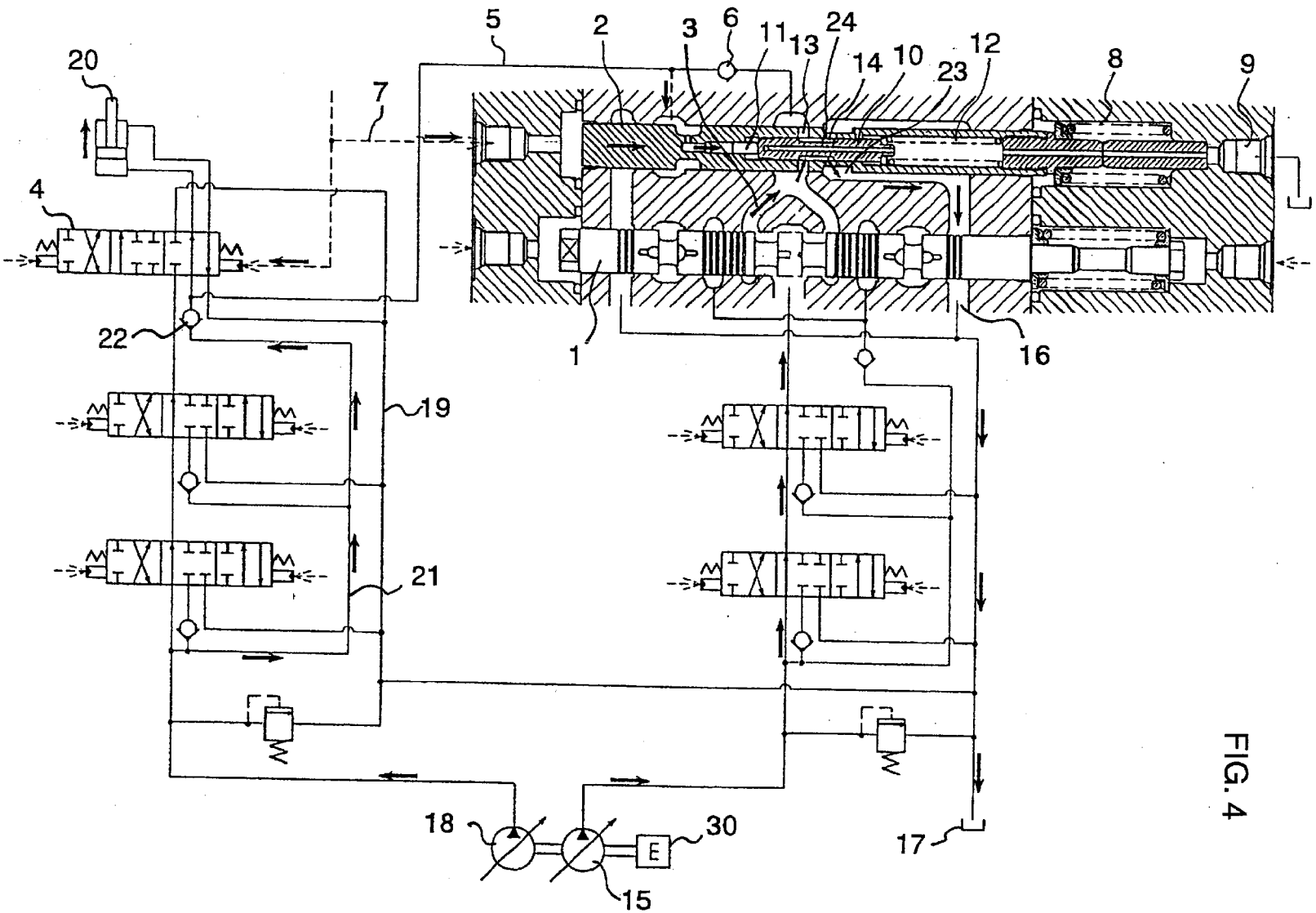
FIG. 4 is a hydraulic circuit diagram illustrating the second embodiment of the present invention at a flow-combination canceling time.

FIGS. 2 through 4 diagrammatically illustrate the second embodiment of the present invention, in which FIG. 2 is the hydraulic circuit diagram showing the hydraulic drive system at the neutral time, FIG. 3 is the hydraulic circuit diagram showing the hydraulic drive system at the flow-combining time, and FIG. 4 is the hydraulic circuit diagram showing the hydraulic drive system at the flow-combination canceling time.

In this second embodiment, a canceling valve 10 is incorporated in a flow-mixing valve 2. Described specifically, the canceling valve 10 is movably arranged within the flow-combining valve 2, a piston 11 is arranged on the side of an end of the canceling valve 10, and a spring 12 by which the canceling valve 10 is biased is disposed on the side of an opposite end of the canceling valve. These piston 11 and spring 12 are also arranged within the flow combining valve 2. Also arranged are a spring 8 for causing the flow-combining valve 2 to return to the neutral position, said spring 8 corresponding to the spring of the flow-combining valve 2 shown in FIG. 1, and a drain port 9 communicating a spring compartment, within which the spring 8 is accommodated, and a reservoir 17 with each other.

Formed through a spool of the flow-combining valve 2 are a small orifice 13, which communicates to the bypass passage 3 connected to the most downstream directional control valve 1 of the first group of directional control valves, and a small opening 14 which can be selectively brought into communication with the bypass passage 3. Further, a passage 23 is formed in an outer peripheral portion of the spool of the flow-combining valve 2. Formed in an outer peripheral portion of a spool of the canceling valve 10 is a passage 24, which is always kept in communication with the above-mentioned small orifice 13 and can be selectively brought into communication with the small opening 14.

The above-mentioned small orifice 13 constitutes a part of the flow-combining valve 2. On the other hand, the small orifice 13, the small opening 14, the passage 24 and the passage 23 constitute parts of the canceling valve 10.

The remaining construction is similar to the above-mentioned first embodiment.

In the second embodiment constructed as described above, when any one of the individual directional control valves is changed over except for the change-over operation that the flow-combining directional control valve 4 is changed over to the right position of FIG. 1, no pilot pressure is developed in the pilot line 7 so that the spool of the flow-combining valve 2 is positioned on the leftmost side of FIG. 2 by the force of the spring 8.

When the flow-combining directional control valve 4 is held neutral or even when the flow-combining directional control valve 4 is changed over to the right position of FIG. 1, the spool of the canceling valve 10 and the piston 11 are held at their leftmost positions of FIG. 2 by the force of the spring 12 when the load pressure on the combined-flow-driven actuator 20 is lower than the predetermined pressure, in other words, lower than a pressure corresponding to the force of the spring 12.

When none of the individual directional control valves included in the first group of directional control valves connected to the first hydraulic pump 15 are changed over in this state, the pressure fluid from the first hydraulic pump 15 is allowed to return to the reservoir 17 via the bypass passage 3, the passage 23 of the flow-combining valve 2, and the reservoir passage 16. When one or more directional control valves included in the first group of directional control valves are changed over, the pressure fluid from the first hydraulic pump 15 can be supplied to the corresponding directional control valve(s) only. When one or more directional control valves included in the second group of directional control valves are changed over, the pressure fluid from the second hydraulic pump 18 can be supplied to the corresponding directional control valve(s) only.

Now assume that, to drive the unillustrated breaker, an unillustrated operating device for the flow-combining directional control valve 4 is operated and a pilot pressure is guided into the pilot line 7. Then, the flow-combining directional control valve 4 is changed over to the right position of FIG. 2 and at the same time, the flow-combining valve 2 is caused to move rightward of FIG. 2 against the force of the spring 8 and takes the position shown in FIG. 3. As a result, the flow-combining valve 2 is brought into the closed position so that the center bypass passage 3 and the reservoir 17 are cut off from each other by the flow-combining valve 2. Accordingly, the pressure fluid from the first hydraulic pump 15 is guided to the supply port of the flow-combining directional control valve 4 via the center bypass passage 3 and the small aperture 13 and further via the flow-combining circuit 5 and the check valve 6, and is combined with the pressure fluid delivered from the first hydraulic pump 18 and guided to the supply ort of the flow-combining directional control valve 4 via the parallel passage 21 and the check valve 22. The combined pressure fluid is then supplied to the combined-flow-driven actuator 20, thereby actuating the combined-flow-driven actuator 20 to drive the unillustrated breaker and hence to perform breaking work or the like of rocks.

At this time, the spool of the canceling valve 10 also moves as an integral element concurrently with the above-mentioned rightward movement of the spool of the flow-combining valve 2. When the load pressure on the combined-flow-driven actuator 20 is lower than the predetermined pressure, the canceling valve 10 is held in the leftmost position by the force of the spring 12, and is held in the closed position at which the canceling valve 10 cuts off the passage 24 and the small opening 14 from each other. As a result, the bypass passage 3 and the reservoir passage 16 are cut off from each other.

To perform combined operation of the breaker and an unillustrated arm and/or boom or combined operation of the breaker and running and/or revolving, the corresponding one or more directional control valves included in the first group of directional control valves, for example, may also be changed over at the same time. In this case, the pressure fluid from the first hydraulic pump 15 is supplied to the corresponding one or more directional control valves. At this time, there is a tendency that, as mentioned above, a portion of the pressure fluid from the first hydraulic pump 15 also flows to the flow-combining circuit 5 and the combined-flow-driven actuator 20 is brought into such a situation that it is driven by the portion of the pressure fluid from the first hydraulic pump 15 and the pressure fluid from the second hydraulic pump 18. While these operations are carried out, overall power control is performed such that a total value of input torques to the first hydraulic pump 15 and the second hydraulic pump 18 does not exceed an output torque from the engine 30 to avoid stalling.

The load pressure on the combined-flow-driven actuator 20 is continuously applied to a control portion of the canceling valve 10 via the flow-combining circuit 5, specifically to an end portion of the piston 11 while the combined-flow-driven actuator 20 is actuated with the combined flow of pressure fluid flows from the two hydraulic pumps 15,18 as mentioned above. When the load pressure becomes higher than a pressure corresponding to the force of the spring 12, however, the piston 11 and the spool of the canceling valve 10 are caused to move rightward so that the canceling valve 10 is changed over to the open position. Namely, as is illustrated in FIG. 4, the center bypass passage 3 and the reservoir passage 16 are brought into communication with each other via the small aperture 13, the passage 24 and the small opening 14, and the combination of flows by the flow-combining valve 2 is canceled. When this state is established, change-over of one or more directional control valves included in the first group of directional control valves makes it possible to supply the pressure fluid from the first hydraulic pump 15 to the corresponding directional control valve(s) only so that only the pressure fluid from the second hydraulic pump 18 is supplied to the combined-flow-driven actuator 20 via the flow-combining directional control valve.

When the load pressure on the combined-flow-driven actuator 20 becomes lower than the predetermined pressure in the above-described state or when the flow combining directional control valve 4 is caused to return to the neutral position in the above-described state, the spool of the canceling valve 10 and the piston 11 return by the force of the spring 12 to the positions shown in FIG. 3 or to the positions shown in FIG. 2 so that the canceling valve 10 is brought into the closed position where the canceling valve 10 cuts off the small aperture 13 and the small opening 14 from each other. When the flow-combining directional control valve 4 is not caused to return to the neutral position and the load pressure on the combined-flow-driven actuator 20 becomes lower than the predetermined pressure, the canceling valve 10 is brought into the position shown in FIG. 3 and the combination of flows is performed again.

When the flow-combining directional control valve 4 is caused to return to the neutral position or is changed over to the left position of FIG. 2 or the like, on the other hand, no pressure is developed in the pilot line 7, and the spool of the flow-combining valve 2 is caused to move to the leftmost position as illustrated in FIG. 2 by the force of the spring 8 shown in FIG. 2, and the flow-combining valve 2 is brought into the open position. As a result, the center bypass passage 3 and the reservoir passage 16 are brought into communication with each other so that the combination of the pressure fluid from the first hydraulic pump 15 with the pressure fluid from the second hydraulic pump 18 is no longer performed.

When this state is established, change-over of one or more directional control valves included in the first group of directional control valves makes it possible to supply the pressure fluid from the first hydraulic pump 15 to the corresponding directional control valve(s) only, and change-over of one or more directional control valves included in the second group of directional control valves makes it possible to supply the pressure fluid from the second hydraulic pump 18 to the corresponding directional control valve(s) only.

As in the above-described first embodiment, the second embodiment constructed as described above can also keep small the total value of the input torques to the first hydraulic pump 15 and second hydraulic pump 18. As a consequence, an increase in the output torque from the engine 30 can be reduced so that the fuel consumption can be lowered. This is economical.

Also assume that combined operation of another actuator, which is not shown and is driven by the pressure fluid from the first hydraulic pump 15, and the combined-flow-driven actuator 20 is being performed. Even when the load pressure on the combined-flow-driven actuator 20 becomes higher than the predetermined pressure in the situation that the combined-flow-driven actuator 20 is driven by the combined flow of a portion of the pressure fluid from the first hydraulic pump 15 and the pressure fluid from the second hydraulic pump 18, it is possible to assure sufficient force by the combined-flow-driven actuator 20 and also to increase the speed of the other actuator. As a consequence, the overall work efficiency can be improved.

In particular, the canceling valve 10 is incorporated in the flow-combining valve 2 in the second embodiment. The flow-combining valve 2 and the canceling valve 10 are, therefore, constructed as an integral unit, thereby achieving a reduction in size. Further, external pipes can be rendered fewer and the overall construction can be simplified. Handling is thus easy upon assembly or the like.

In the above-described embodiments, a hydraulic excavator was referred to as an example of the work machine. However, the work machine to which the present invention is applied is not limited to such a hydraulic excavator, and the present invention can be applied to any work machine insofar as it is provided with a combined-flow-driven actuator, in which flows of pressure fluid from two hydraulic pumps are combined, and also with a flow-combining valve.

INDUSTRIAL APPLICABILITY

According to the invention as described in each of the claims of the present application, when a load pressure on a combined-flow-driven actuator in which flows of pressure fluid from two hydraulic pumps are combined becomes higher than a predetermined pressure, the combination of flows is forcedly stopped so that the combined-flow-driven actuator is driven with the pressure fluid from only one of the hydraulic pumps. This makes it possible to reduce an input torque to the other hydraulic pump which is not affected by the load pressure on the combined-flow-driven actuator. A total value of input torques to these two hydraulic pumps can, therefore, be kept lower than that in the conventional art. As a consequence, an increase in the output torque of an engine can be reduced, thereby making it possible to reduce the fuel consumption. The invention of the present application as described in each of the claims is, therefore, economical compared with the conventional art.

Assume that combined operation of another actuator, which is driven by the pressure fluid from one of the two hydraulic pumps, and the combined-flow-driven actuator is being performed. When the load pressure on the combined-flow-driven actuator becomes higher than a predetermined pressure in the situation that the combined-flow-driven actuator is driven by the combined flow of a portion of the pressure fluid from the one hydraulic pump and the pressure fluid from the other hydraulic pump, the pressure fluid from the one hydraulic pump can be supplied to the other actuator only. Further, the delivery pressure of the one hydraulic pump is no longer affected by the load pressure on the combined-flow-driven actuator, and therefore, can be kept smaller compared with the delivery pressure of the other hydraulic pump. This makes it possible to assure a relatively large flow rate in accordance with the so-called P-Q characteristics (pump-delivery pressure characteristics), thereby making it possible to assure sufficient force by the combined-flow-driven actuator and also to increase the speed of the other actuator during such combined operation. Accordingly, overall work efficiency can be improved over that available from the conventional art.

According to the present invention as described especially in claim 3, the flow-combining valve and the canceling valve are constructed as an integral unit, thereby making it possible to achieve a reduction in size. Further, external pipes can be rendered fewer and the overall construction can be simplified. Handling is thus easy upon assembly or the like.

What is claimed is:

1. A hydraulic drive system for a work machine, said hydraulic drive system being provided with an engine, a first and second variable displacement hydraulic pumps drivable by said engine, a first group of center-bypassed directional control valves connected to said first hydraulic pump, a second group of center-bypassed directional control valves connected to said second hydraulic pump and including a flow-combining directional control valve, a flow-combining valve connected to a most downstream directional control valve of said first group of directional control valves via a center bypass passage to supply pressure fluid from said first hydraulic pump, in combination with pressure fluid from said second hydraulic pump, to said flow-combining directional control valve in said second group of directional control valves, a flow-combining circuit communicating said flow-combining valve and a supply port of said flow-combining directional control valve with each other, a combined-flow-driven actuator controlled by said flow-combining directional control valve, and a variable displacement controller for performing overall power control such that a total value of an input torque to said first hydraulic pump and an input torque to said second hydraulic pump does not exceed an output torque of said engine, comprising:

a canceling valve for canceling said flow combination by said flow-combining valve when a load pressure on said combined-flow-driven actuator becomes higher than a predetermined pressure.

2. A hydraulic drive system according to claim 1, wherein said canceling valve is arranged in a circuit communicating said center bypass passage, which is located between said most downstream directional control valve of said first group of directional control valves and said flow-combining valve, and a reservoir with each other, and is set to be actuatable responsive to a pressure in said flow-combining circuit.

3. A hydraulic drive system according to claim 1 or 2, wherein said canceling valve is incorporated in said flow-combining valve.

4. A hydraulic drive system according to claim 1 or 2, wherein said work machine is a hydraulic excavator, and an attachment drivable by said combined-flow-driven actuator is a predetermined accessory mounted on a free end of an arm.

5. A hydraulic drive system according to claim 3, wherein said work machine is a hydraulic excavator, and an attachment drivable by said combined-flow-driven actuator is a predetermined accessory mounted on a free end of an arm.

* * * * *